US005585335A

United States Patent [19]

Andrew et al.

[11] Patent Number: 5,585,335

[45] Date of Patent: Dec. 17, 1996

[54] IMIDE AND PYRROLIDONE GREASE THICKENERS WITH TEREPHTHALATE COMPLEXING AGENT

[75] Inventors: David L. Andrew, Strathroy; David A. Slack, Sarnia, both of Canada

[73] Assignee: Exxon Research and Engineering Company, Florham Park, N.J.

[21] Appl. No.: 614,116

[22] Filed: Mar. 12, 1996

[51] Int. Cl.[6] ..... C10M 133/44; C10M 117/02

[52] U.S. Cl. ..... 508/268; 508/296; 508/297; 508/525

[58] Field of Search ..... 252/33.6, 51.5 A, 252/57

[56] References Cited

U.S. PATENT DOCUMENTS

| | | | |
|---|---|---|---|
| 3,224,968 | 12/1965 | Henkamp | 252/33.6 |
| 4,253,979 | 3/1981 | Alexander et al. | 252/33.6 |
| 4,822,503 | 4/1989 | Norton et al. | 252/33.6 |
| 4,897,210 | 1/1990 | Newsoroff | 252/41 |

FOREIGN PATENT DOCUMENTS 9411470 5/1994 WIPO .

*Primary Examiner*—Jacqueline V. Howard
*Attorney, Agent, or Firm*—Roy J. Ott

[57] ABSTRACT

A grease composition comprises an effective amount of a lubricating oil containing an imide or pyrrolidone thickening agent or an imide or pyrrolidone thickening agent comprising a metal salt of a carboxylic acid in combination with a bimetal phthalate complexing agent, such as dilithium terephthalate. The presence of the complexing agent results in a grease having properties superior to that of a similar grease without the complexing agent. Preferred complexing agents are dimetal terephthalates in which the metal is an alkali or alkaline earth metal and is the same metal as is present in the thickener. An example is a combination of a calcium or lithium salt of the reaction product of trimellitic anhydride with a hydrogenated rapeseed amine and a dilithium terephthalate complexing agent.

11 Claims, No Drawings

IMIDE AND PYRROLIDONE GREASE THICKENERS WITH TEREPHTHALATE COMPLEXING AGENT

BACKGROUND OF THE DISCLOSURE

1. Field of the Invention

The invention relates to imide and pyrrolidone grease thickeners and their use with a phthalate complexing agent. More particularly the invention relates to a grease and a grease thickening system comprising (i) an imide or pyrrolidone thickener and (ii) an imide or pyrrolidone thickener in combination with a metal phthalate complexing agent, such as dilithium terephthalate.

2. Background of the Invention

Grease is a semi-fluid medium comprised of a liquid lubricant and a thickening agent. The liquid lubricant is derived from natural mineral oils, synthetic hydrocarbons, esters, ethers, polysiloxanes, fluorocarbon polymers and the like. The thickening agent is typically dispersed in the liquid lubricant at a concentration between 5 and 20 wt. %. A number of different compounds are used as grease thickeners. For example, mineral oils are thickened by alkali soaps of fatty acids, clays, polymers, phthalocyanines, organic dyes, polyureas and aluminum soaps, among others. Soap based thickeners containing alkali metal salts of natural fatty acids are widely used, particularly those of lithium, calcium and sodium. Pyrrolidone thickeners have also been used as disclosed in U.S. Pat. No. 4,253,979 the disclosure of which is incorporated herein by reference. Lithium stearates and their hydroxy-substituted derivatives appear to dominate the grease market at the present time. The use of a long chain lithium monocarboxylate together with an aliphatic dilithium dicarboxylate as a grease thickener, is known. German patent publication DT-362596 assigned to the assignee of the present invention discloses a combination of lithium 12-hydroxystearate and dilithium azealate. U.S. Pat. No. 4,897,210 discloses a dilithium salt of a terephthalate acid alkyl ester and a lithium salt of 12-hydroxystearic acid as a grease thickener. Japanese patent publication J-59157191 relates to saponifying a silicone base oil composition with lithium hydroxide, wherein the base oil contains a terephthalic acid ester such as methyl N-octadecyl terephthalamate, while Japanese patent publication J-9145297 relates to a similar process with a hydrocarbon base oil containing an N-substituted terephthalamine ester, such as N-octadecyl terephthalamine-methyl.

SUMMARY OF THE INVENTION

The invention relates to imide and pyrrolidone grease thickeners and to their use with a phthalate complexing agent as a grease thickening system. Another embodiment of the invention relates to a grease containing an imide or pyrrolidone thickener. In yet another embodiment the invention relates to a grease containing an imide or pyrrolidone thickener in combination with a metal phthalate complexing agent. The phthalate complexing agent is a metal salt, and preferably a dimetal salt of one or more of terephthalate, phthalate, isophthalate or mixture thereof in which the metal is an alkali or alkaline earth metal. By imide or pyrrolidone thickener is meant a grease thickening compound having imide or pyrrolidone chemical functionality useful for forming a grease when added in an effective amount to a liquid lubricant such as a hydrocarbon oil and particularly to a hydrocarbon oil having a lubricating quality. Pyrrolidones and imides useful as thickeners in the practice of the invention include one or more organic compounds which comprise a metal salt of a carboxylic acid connected by an imide or substituted pyrrolidone group linkage to an alkyl or alkenyl hydrocarbon chain, and particularly such compounds wherein the metal is an alkali or alkaline earth metal. An illustrative, but nonlimiting example of such compounds which have been found useful in the practice of the invention includes a metal salt of an aryl monocarboxylic acid connected to a fatty amine hydrocarbon through an imide or substituted pyrrolidone linkage. One embodiment of the invention relates to pyrrolidone grease thickeners as described above having only one pyrrolidone group, although the embodiment relating to the use of pyrrolidone and imide thickeners in combination with a metal phthalate, and particularly a dimetal terephthalate, is not limited to pyrrolidone thickeners having only one pyrrolidone group. It is preferred that the metal of the imide or pyrrolidone thickener be the same as the metal of the phthalate complexing agent. In a preferred embodiment, the phthalate complexing agent used in combination with the imide or pyrrolidone thickener comprises a dimetal terephthalate in which the metal is an alkali or alkaline earth metal, such as dilithium terephthalate. The combination of an imide or pyrrolidone thickener and the metal terephthalate complexing agent in a grease results in the grease possessing increased dropping point, better mechanical shear stability, and superior water resistance compared to the same grease containing the imide or pyrrolidone thickener, but without the presence of the terephthalate complexing agent.

DETAILED DESCRIPTION

As set forth above, in one embodiment a grease composition of the invention comprises a liquid lubricant and an effective amount of an imide or pyrrolidone thickening agent of the invention. In a preferred embodiment a grease composition of the invention comprises an effective amount of an imide or pyrrolidone thickening agent, along with a metal phthalate complexing agent, and more preferably an imide or pyrrolidone grease thickener of the invention in combination with a dimetal phthalate complexing agent. The phthalate complexing agent is a metal salt, and preferably a dimetal salt of one or more of terephthalate, phthalate, isophthalate or mixture thereof in which the metal is an alkali or alkaline earth metal. Pyrrolidones and imides useful as thickeners in the practice of the invention include one or more organic compounds which comprise a metal salt of a carboxylic acid connected by an imide or substituted pyrrolidone linkage to an alkyl or alkenyl hydrocarbon chain, and particularly such compounds wherein the metal is an alkali or alkaline earth metal. An illustrative, but nonlimiting example of such compounds which have been found useful in the practice of the invention includes a metal salt of an aryl monocarboxylic acid connected to a fatty amine hydrocarbon through an imide or substituted pyrrolidone. Those skilled in the art will appreciate that a substituted pyrrolidone is a pyrrolidone wherein one or more of the hydrogen atoms on the pyrrolidone ring is substituted with another group. It is preferred that the metal of the imide or pyrrolidone thickener be the same as the metal of the phthalate complexing agent. The liquid lubricant is derived from natural mineral oils, synthetic hydrocarbons, esters, ethers, polysiloxanes, fluorocarbon polymers and the like. The thickener system comprising the imide or pyrrolidone thickener along with the phthalate complexing agent is dispersed in the liquid lubricant to form a grease in which the thickener system is present at a concentration broadly ranging between 2–30 wt. % and more generally from 5–20 wt. % of the grease.

The imide or pyrrolidone thickeners of the invention will form a grease when dispersed in an oil having a lubricating quality, but the grease will not be as good as the preferred embodiment in which both the imide or pyrrolidone thickener and the phthalate complexing agent are present in the grease. Further, while grease compositions according to the invention have been found to be particularly effective when an imide or pyrrolidone thickener of the invention is present, it is not intended that the thickening system comprising a combination of an imide or pyrrolidone thickener and the phthalate thickening agent be limited to only those imide and pyrrolidone compositions of the invention set forth below.

The thickener system of the invention is comprised of two parts. The first part is the primary thickener which is the imide or pyrrolidone and the second is the phthalate complexing agent. The imide and pyrrolidone thickener molecules have an oil soluble component and a polar component. It is believed that these two components permit the thickener molecules to "gel" the oil molecules together by facilitating short range interactions between the polar components of individual thickener molecules. The complexing agent does not have a component soluble in a hydrocarbon oil and therefore does not directly contribute to the thickening of the grease with a hydrocarbon lubricating oil grease composition. The complexing agent is believed to improve the ancillary properties of the thickener molecules by contributing to the polar-polar interactions. While not wishing to be held to any particular theory, it is believed that the phthalate complexing agent acts as a link between the polar ends of two or more thickener molecules. This may be due to Van der Waals forces, ionic bonding, hydrogen bonding, dipole moments and the like.

The complexing agent useful in the practice of the invention is one or more metal phthalate salts and preferably dimetal phthalate salts in which the metal is the same as the metal of the thickener molecules and is an alkali (Group I) or alkaline earth (Group II) metal. Preferred metals, in decreasing order of preference are Li, Ca, Na and Ba. Useful phthalates include terephthalate, phthalate and isophthalates, with terephthalate being preferred. The carboxylic salt of the terephthalate, phthalate or isophthalate is obtained by neutralizing the acid precursor with the metal hydroxide or by hydrolyzing a suitable ester precursor with an aqueous solution of the metal hydroxide as is known to those skilled in the art. Illustrative, but nonlimiting ester precursors include, methyl, ethyl, propyl and butyl esters. The phthalates and methods for forming the corresponding metal phthalates are known to those skilled in the art and need not be mentioned further.

Pyrrolidone thickeners have been made which have been found to be useful in the practice of the invention and include compounds having a substituted pyrrolidone group of the type set forth below wherein one of the hydrogens on the pyrrolidone ring has been substituted with an amide,

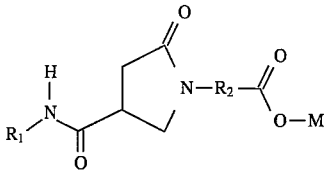

wherein $R_1$ is a straight or branched chain alkyl or akenyl group having from 6 to 30 carbon atoms, preferably from 12 to 25 carbons and which may also contain nitrogen, sulfur, oxygen or phosphorus functionality. In one embodiment $R_1$ is selected from the group consisting essentially of $C_{16}$, $C_{18}$, $C_{20}$ and $C_{22}$ alkyl groups, and mixture thereof. $R_2$ is a hydrocarbyl group and may be aryl, alkenyl or alkyl and, in addition, may also possess oxygen, nitrogen, sulfur or phosphorus based functionality. Preferred groups in decreasing order of preference are para-phenyl, meta-phenyl, $C_1$, ortho-phenyl and saturated $C_2$, $C_3$, $C_4$ or $C_5$ groups. As is the case for the phthalate complexing agent, the metal M is a Group I or Group II metal with preferred metals, in decreasing order of preference, being Li, Ca, Na and Ba. Again, the carboxylic salt may be obtained by neutralizing the acid precursor with a Group I or Group II metal hydroxide or by hydrolyzing a suitable ester precursor with an aqueous solution of a Group I or a Group II metal hydroxide. Illustrative, but nonlimiting ester precursors include methyl, ethyl, propyl and butyl esters. These new pyrrolidone thickeners of the invention have only one pyrrolidone group and may be used in a grease composition alone, with other pyrrolidone thickeners, with one or more imide thickeners including imide thickeners of the invention and with metal phthalate complexing agents.

Imide thickeners have been made which have been found to be useful in the practice of the invention and include compounds having imide functionality of the type set forth below,

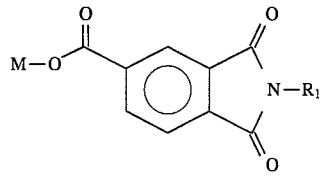

wherein $R_1$ is a straight or branched chain alkyl or alkenyl group having from 6 to 30 carbon atoms, preferably from 12 to 25 carbons and which may also contain nitrogen, sulfur, oxygen or phosphorus functionality. In one embodiment $R_1$ is selected from the group consisting essentially of $C_{16}$, $C_{18}$, $C_{20}$ and $C_{22}$ alkyl groups, and mixture thereof. M is a Group I or II metal, with preferred metals, in order of decreasing preference, being Li, Ca, Na and Ba. As is the case for the pyrrolidone thickener, the carboxylic salt may be obtained by neutralizing the acid precursor with metal hydroxide or by hydrolyzing an ester precursor with an aqueous metal hydroxide solution. Illustrative, but nonlimiting examples of suitable ester precursors include methyl, ethyl, propyl and butyl esters.

Other imide thickeners which have been made and which have been found to be useful as grease thickeners in the practice of the invention include compounds having the formula of the type set forth below,

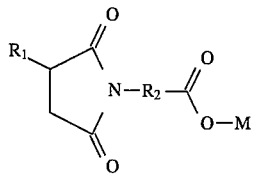

wherein $R_1$ is a straight or branched chain alkyl or alkenyl group having from 6 to 30 carbon atoms, preferably from 12 to 25 carbons and which may also contain nitrogen, sulfur, oxygen or phosphorus functionality. In one embodiment $R_1$ is selected from the group consisting essentially of $C_{16}$, $C_{18}$, $C_{20}$ and $C_{22}$ alkyl groups, and mixture thereof. $R_2$ is a hydrocarbyl group and may be aryl, alkenyl or alkyl and, in addition, may also possess oxygen, nitrogen, sulfur or phosphorus based functionality. Preferred groups in decreasing order of preference are para-phenyl, meta-phenyl, $C_1$, ortho-phenyl and saturated $C_2$, $C_3$, $C_4$ or $C_5$ groups. As is the case for the phthalate complexing agent, the metal M is a Group I or Group II metal with preferred metals, in decreasing order of preference, being Li, Ca, Na and Ba. Again, the carboxylic salt may be obtained by neutralizing the acid precursor with a Group I or Group II metal hydroxide or by hydrolyzing a suitable ester precursor with an aqueous solution of a Group I or a Group II metal hydroxide. Illustrative, but nonlimiting ester precursors include methyl, ethyl, propyl and butyl esters.

One example of an imide-based grease thickener or thickening agent useful in the practice of the invention comprises the reaction product of a commercially available succinic derivative, octadecenylsuccinic anhydride (ODSA), with the lithium salt of para-aminobenzoic acid (LiPABA). This reaction proceeds smoothly and the procedure used to make this is set forth in Example 6.

Another example of a grease thickener useful in the practice of the invention comprises a reaction product of itaconic acid with para-aminobenzoic acid (PABA) to form a diacidic pyrrolidone (DAP). This reaction proceeds along smoothly at 170° C. in a paraffinic hydrocarbon base oil, but the DAP is insoluble and crystallizes on the wall of the reaction vessel according to the following reaction:

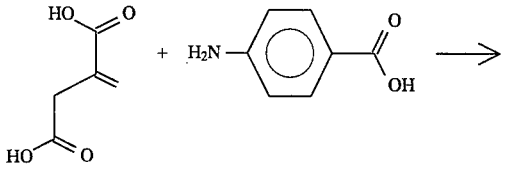

Itaconic Acid PABA

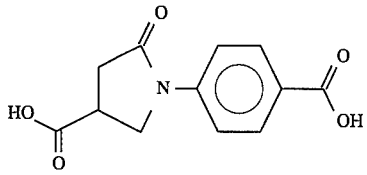

DAP

The addition of a fatty acid amine to the reaction mixture at 180° C. results in the formation of a fatty mono-acidic pyrrolidone shown below, in which the fatty acid amine used with the DAP is Armeen HR available from Akzo Chemie America and is derived from hydrogenated rapeseed oil and contains a 1:1 molar ratio of the corresponding $C_{18}$ and $C_{22}$ primary amines.

DAP + $C_{18}/C_{22}$ amine ⟶

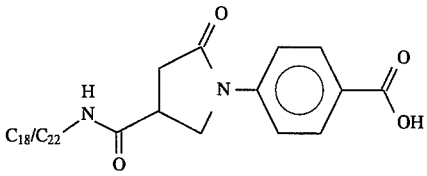

FMP

Neutralization of the FMP with lithium hydroxide results in the formation of a lithium fatty mono-pyrrolidone (Li FMP) which is a high quality grease thickener. At a concentration of 16 wt. % in a mineral base oil of lubricating quality this thickener results in a grease. The reaction of the FMP with the LiOH is:

FMP + LiOH ⟶

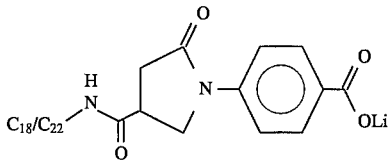

LiFMP

The properties of this grease are improved by adding dilithium terephthalate as a grease thickener complexing agent.

In another embodiment of the invention, trimellitic anhydride (TMA) and the hydrogenated rapeseed amine are heated in a paraffinic mineral base oil of lubricating quality at 180° C. to form the fatty trimellitic imide (FTMI) shown below.

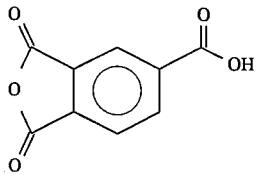

+ $C_{18}/C_{22}$ amine ⟶

TMA

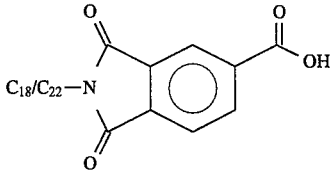

FTMI

FTMI is an oil soluble compound that begins to act as a grease thickener below 105° C. By neutralizing the carboxylic acid function in FTMI with lithium hydroxide or calcium hydroxide and heating the mixture to 205° C. or 145° C., respectively, a high quality grease thickener is formed according to the reaction shown below.

FIMI + LiOH or $1/2Ca(OH)_2$ ⟶

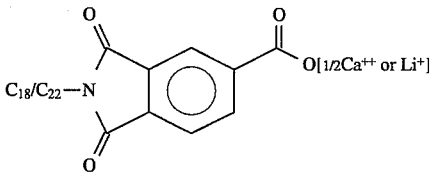

However, the thickening efficiency of a grease formed with this material is not as high as it is desired. Dilithium terephthalate is therefore added to the grease in a two step process. In the first step the Li- or Ca-FTMI thickener system is formed. In the second step terephthalic acid is added to the grease and then neutralized with lithium hydroxide. The grease is then heated to a finishing temperature of 215° C. after formation of the DLT to yield a grease having a much higher dropping point temperature.

The pyrrolidone and imide compositions of the invention set forth above are effective thickeners in themselves, although their effectiveness is substantially enhanced by the addition of the phthalate complexing agent. If it is desired to use one or more of the imide or pyrrolidone thickeners, or a mixture of imide and pyrrolidone thickeners, in a grease composition without the presence of the phthalate complexing agent, an effective amount of thickener will range from about 7–25 wt. % of the grease composition in the case of the pyrrolidone thickener, 7–30 wt. % for the imide and 7–25 wt. % for the imide when Ca is the metal. When it is desired to use the thickener system of the invention which comprises an imide, pyrrolidone or mixture of imide and pyrrolidone thickener in combination with the dimetal phthalate complexing agent, the mole ratio of the complexing agent to an imide and/or pyrrolidone thickener will typically range from 0.5–10 and preferably from 0.5–4. It is preferred that the metal be the same for the thickener and complexing agent. Further, if a mixture of imide thickeners, or a mixture of imide and pyrrolidone thickeners is used, $R_1$ and $R_2$ may be the same or different for each thickener compound. When using an imide or pyrrolidone thickener of the invention, the mole ratio of a preferred embodiment employing a dilithium terephthalate complexing agent with a lithium salt of an imide or pyrrolidone thickener of the invention will be about 2.2.

The invention will be further understood with reference to the examples below.

EXAMPLES

In all of the examples below, the cone penetration test is the cone penetration after 60 strokes performed according to ASTM D 217. This test is used to determine the consistency of the grease. The lower the number, the thicker is the grease. Cone penetration after 100,000 strokes was also performed according to ASTM D 217 and is used to determine how stable the grease is to mechanical shearing action. The 100k stroke pen is compared to the 60 stroke pen to determine the change in consistency. The wet shell roll is used to determine the stability of the grease thickener system in the presence of water. Two measurements are made in this test. First the amount of water absorbed is determined. Then the change in the 60 stroke half scale penetration is measured. The wet shell roll test is based on ASTM D 1831 modified for 100 g of grease and 100 g of water which are rolled in the test equipment for an hour at 25° C. Finally, the dropping point is performed according to ASTM D 2265 and is used to determine the high temperature stability limit of the grease. The dropping point is conceptually similar to the melting point of the thickener-oil system.

Example 1

In this experiment, 607 g of a paraffinic, hydrocarbon base oil having a viscosity of from 100–118 cSt at 40° C. and 10.8–12.0 cSt at 100° C. is placed in a Hobart mixing kettle, heated to 120° C., with 30.6 g of itaconic acid and 32.3 g of para-aminobenzoic acid added to the oil. This oil has a lubricating quality. The solid acids do not dissolve in the oil. The temperature is raised to 160° C. and held there for 60 minutes. A considerable amount of foaming and bubbling is observed as the solids melt and react. After foaming subsides, a solid white cake is observed on the sides of the grease kettle. Then 70.0 g of Armeen HR is added to the 160° C. reaction mixture, the temperature raised to 180° C. and held there for 90 minutes. More bubbling is observed as the solid white cake begins to react. Eventually, all of the white solid initially caked on the walls of the kettle reacts and the reaction mixture is dark brown. The dark brown mixture is cooled to 90° C., 10.31 g of $LiOH.H_2O$ dissolved in 60 ml of water is added and the temperature raised to 150° C. After 60 minutes complete dehydration is achieved. The temperature is then raised to 180° C. and held there for 60 minutes. The brown fluid begins to thicken into a grease after prolonged mixing at this temperature. The resulting grease is then heated to a temperature of 200° C. at which it is held for 20 minutes. The grease is then cooled back down to ambient temperature, milled, and then oiled back with 99 g of the paraffinic oil.

The final composition of the so-formed Li-FMP grease is set forth in Table 1 below.

TABLE 1

| | Total mass, g | Content, wt. % |
|---|---|---|
| Paraffinic oil | 706 | 83.14 |
| Armeen HR | 70.0 | 8.24 |
| Itaconic acid | 30.6 | 3.60 |
| Para-aminobenzoic acid | 32.3 | 3.80 |
| $LiOH.H_2O$ | 10.31 | 1.21 |

Example 2

In this example 460 g of the paraffinic base oil used in Example 1 is placed in a Hobart mixing kettle and heated to 120° C., with 30.6 g of itaconic acid and 32.3 g of para-aminobenzoic acid added to the oil to form a reaction mixture. Continued heating brings the temperature of the reaction mixture up to 160° C. and a considerable amount of foaming and frothing is observed as the acid solids melt and begin to react. After foaming subsides, a solid white cake is observed on the sides of the reaction vessel. Then 74.0 g of a hydrogenated rapeseed amine (Armeen HR) is added, the temperature raised to 180° C. and held for 50 minutes. More bubbling is observed as the solid white cake reacts. All of the solid white cake on the sides of the reaction vessel reacts and a dark brown homogeneous solution is formed which is cooled down to 90° C. Then 10.4 g of lithium hydroxide monohydrate, $LiOH.H_2O$, in 50 ml of water is added and the temperature raised to 160° C. to achieve dehydration. After 40 minutes complete dehydration is achieved. The reaction mixture is cooled down to 90° C. and 20.1 g of terephthalic acid is added. After thorough mixing, an additional 10.8 g of $LiOH.H_2O$ in 40 ml of water is added to the reaction mixture. The temperature is raised to 160° C. and held until complete dehydration is achieved, after which the temperature is raised to 210° C. The reaction mixture thickens into a high quality grease after 15 minutes heating at 210° C. The grease is cooled down to ambient temperature, oiled back with 321 g of the paraffinic base oil, milled, and then reheated up to 210° C. The grease is then slowly cooled back down to ambient temperature with constant mixing. Reheating the grease after it has been cooled seems to improve its appearance as well as the thickener yield.

The final composition of this so-formed Li-FMP terephthalate complex grease is set forth in Table 2 below.

TABLE 2

| | Total mass, g | Content (wt. %) |
|---|---|---|
| Paraffinic oil | 781 | 81.42 |
| Armeen HR | 74.0 | 7.71 |
| Itaconic acid | 30.6 | 3.19 |
| Para-amino benzoic acid | 32.3 | 3.37 |
| Terephthalic acid | 20.1 | 2.10 |
| $LiOH.H_2O$ | 21.2 | 2.21 |

Example 3

In this experiment, 481 g of the paraffinic oil used in Example 1 is heated in a Hobart mixing kettle and heated to 120° C. As the temperature approaches 120° C., 100 g of Armeen HR is added to the oil. The mixture is heated to 180° C. and 65 g of trimellitic anhydride added over a period of 20 minutes. A considerable amount of foaming and bubbling is observed after each addition of trimellitic anhydride, after which the mixture is stirred for an additional 10 minutes and is black. The black mixture is cooled to 95° C. and the fluid thickness to a light-brown paste below 110° C. At a temperature of 95° C., 20.0 g of $LiOH.H_2O$ in 60 ml of water is added and the consistency of the mixture becomes very fluid-like. The reaction temperature is increased to 130° C. and as the temperature begins to rise, a considerable amount of foaming and bubbling is observed. A drop of the Viscal anti-foaming agent is added. The reaction temperature is raised to 150° C. to complete the dehydration process, then raised to 180° C. and held at this temperature for 60 minutes. The reaction mixture is then heated to a temperature of 205° C. and held there for 15 minutes. The reaction mixture begins to thicken into a grease after 30 minutes at 180° C. and the consistency is improved by continued heating to the 205° C. temperature. The grease is cooled down to ambient temperature overnight and then oiled back with 164 of the paraffinic oil, with the final product then milled to result in a very smooth pale brown grease.

The final composition of the so-formed Li-FTMI grease is set forth in Table 3 below.

TABLE 3

| | Total mass, g | Content (wt. %) |
|---|---|---|
| Paraffinic oil | 645 | 77.80 |
| Armeen HR | 100 | 12.06 |
| Trimellitic anhydride | 64 | 7.72 |
| $LiOH.H_2O$ | 20 | 2.41 |

Example 4

In this example 417 g of the paraffinic base oil used in Example 1 above is placed in a Hobart mixing kettle and heated to 185° C., with 84.32 g of the Armeen HR added to the hot oil as the temperature approaches 120° C. When the temperature reaches 185° C., 52.50 g of trimellitic anhydride is added to the mixture over a period of 35 minutes. A considerable amount of foaming and bubbling is observed after each addition of the trimellitic anhydride. The mixture is stirred at 180° C. for an additional 20 minutes after the final addition of the trimellitic anhydride and is black. The black mixture is then cooled down to 100° C., with the fluid thickening into a light brown paste below 110° C. At 100° C., 14.0 g of $LiOH.H_2O$ in 60 ml of water is added to the paste and the consistency of the mixture becomes very fluid-like. The reaction temperature is then increased to 130° C. and a considerable amount of foaming and bubbling is observed as the temperature rises. A drop of a silicon-based anti-foam is added to prevent the reaction from overflowing the grease kettle. The reaction temperature is raised to 180° C. to complete the dehydration process. The temperature is then raised to 205° C. and held for 10 minutes. The mixture is cooled down to 100° C. and 21.0 g of terephthalic acid is added to the pale brown grease. After thorough mixing, 17.0 g of $LiOH.H_2O$ in 50 ml of water is added to the grease. The consistency of the grease becomes very fluid-like after addition of the lithium slurry. The temperature is then raised to 150° C. and complete dehydration is achieved in 20 minutes. The temperature is then raised to 180° C. and held for an hour, followed by raising it up to 215° C., at which temperature the mixture begins to thicken. The grease is then cooled down to ambient temperature, oiled back with 277 g of the paraffinic oil, and the final product milled to a very smooth pale brown grease.

The final composition of the so-formed Li-FTMI terephthalate grease is set forth in Table 4 below.

TABLE 4

| | Total mass, g | Content (wt. %) |
|---|---|---|
| Paraffinic oil | 694 | 78.61 |
| Armeen HR | 84.32 | 9.55 |
| Trimellitic anhydride | 52.5 | 5.95 |
| Terephthalic acid | 21.0 | 2.38 |
| $LiOH.H_2O$ | 31.9 | 3.51 |

Example 5

In this example 457 g of the paraffinic base oil used in Example 1 is placed in a Hobart mixing kettle and heated to 180° C., with 100 g of Armeen 18 (a $C_{18}$ saturated alkyl amine) added to the oil as it is being heated and 65 g of trimellitic anhydride (TMA) added over a period of 30 minutes after the temperature reaches 180° C. Bubbling and foaming is observed after each addition of the TMA. The fluid mixture turns black, but turns light-brown on cooling below 110° C. To this is added 50 g of terephthalic acid and the resulting grease mixed thoroughly, followed by adding 37 g of calcium hydroxide. The temperature is raised to 125° C. and 15 g of water added to the grease which is then mixed at this temperature for an hour to dehydrate the grease. The temperature of the dehydrated grease is raised to 145° C. and held there for one-half hour. The grease is cooled to room temperature overnight, oiled back with 1016 g of the base oil and milled.

Example 6

A solution of 40 g of para-aminobenzoic acid and 13.5 g of $LiOH.H_2O$ in 100 ml of water is made and dehydrated for 2 days in a 95° C. oven to produce a solid cake which is ground into a powder. This powder is added to 830 g of the paraffinic base oil used in Example 1 in a Hobart kettle at 125° C., followed by 100 g of octadecenylsuccinic anhydride which is added in small amounts over a 20 minute period. Foaming is observed after each addition. The temperature is raised to 175° C. and held there for an hour to form a brown fluid which thickens into a grease after 30 minutes. The grease is cooled to room temperature, oiled back with 35 g of the base oil and milled.

Test Results

The test results of the greases prepared according to the foregoing Examples are set forth in the Table below.

| | EXAMPLE | | | | | |
|---|---|---|---|---|---|---|
| | 1 | 2 | 3 | 4 | 5 | 6 |
| Property | | | | | | |
| Consistency 60X pen (mm/10) | 285 | 280 | 375 | 304 | 284 | 271 |
| Dropping point, °C. | 205 | 330 | 244 | 324 | 154 | 257 |
| Wet shell roll | | | | | | |
| % water absorbed | 100 | 60 | | 100 | 100 | 100 |
| Δ 60X pen (m/10) | −85 | −24 | | degels | +18 | +259 |
| Shear stability | | | | | | |
| 100KX pen (mm/10) | +88 | +49 | +80 | +40 | +40 | +84 |

Comparing Examples 1 and 2 demonstrates the effect of the dilithium terephthalate (DLT) complexing agent on a pyrrolidone thickener system. The grease composition of Example 1 contains the Li-FMP pyrrolidone thickener without the DLT complexing agent, whereas the grease of Example 2 contains the Li-FMP pyrrolidone thickener with the DLT complexing agent. Including the DLT complexing agent in the pyrrolidone grease formulation results in increasing the dropping point of the grease from 205° C. to 330° C. The presence of the DLT also improves the resistance of the grease to mechanical shearing action. Without the DLT, the pyrrolidone grease undergoes an 88 point softening after being subjected to 100,000 strokes in an ASTM D 217 standard grease worker. In contrast, the pyrrolidone grease which contains the DLT complexing agent is more shear-stable and therefore only undergoes a 49 point softening in the 100,000 stroke worked penetration test. In addition to dropping point and shear stability improvements, the DLT complexing agent also increases the water resistance of the pyrrolidone greases. The improvement in the water resistance characteristics of the pyrrolidone grease containing the DLT complexing agent results in an observable reduction in the amount of water that is absorbed during the wet shell roll test and a reduction in the change in consistency of the grease.

Comparing Examples 3 and 4 demonstrates the effect of the dilithium terephthalate (DLT) complexing agent on a pyrrolidone thickener system. The grease composition of Example 3 contains the Li-FTMI imide thickener without the DLT complexing agent, whereas the grease of Example 4 contains the Li-FTMI imide thickener with the DLT complexing agent. Including the DLT complexing agent in the imide grease formulation results in increasing the dropping point of the grease from 244° C. to 324° C. The presence of the complexing agent also improves the shear stability of the imide thickened grease which results in a reduction in the penetration observed after 100,000 strokes the ASTM D 217 grease worker. Neither of these two imide greases are exceptionally resistant to water and both degel in the wet shell test. However, Example 5 demonstrates that using calcium as the metal in the imide thickener and in the terephthalate complexing agent improves the water resistance, as seen by only a minor change in consistency when subjected to the wet roll test.

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A grease comprising an oil having lubricating quality and an effective amount of a thickening agent selected from the group consisting essentially of a pyrrolidone, an imide and mixture thereof, wherein if only a pyrrolidone is present it contains only one pyrrolidone group and is of the formula

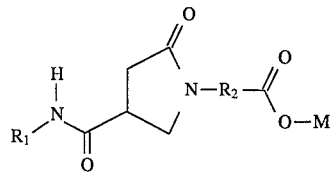

wherein if only an imide is present it is of the formula

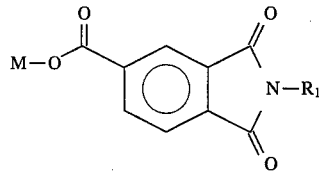

or

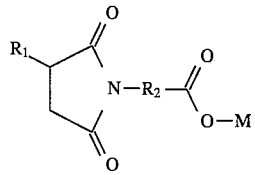

or a mixture of said imides, wherein $R_1$ is a straight or branched chain alkyl or alkenyl group having from 6 to 30 carbon atoms and which may also contain one or more of N, O, S or P, wherein $R_2$ is a hydrocarbyl group which may also contain one or more of N, O, S or P, wherein M is a Group I or II metal, wherein $R_1$ and $R_2$ are the same or different and wherein said grease contains at least one of said pyrrolidone or said imides defined above.

2. A grease according to claim 1 wherein $R_2$ is aryl, alkenyl or alkyl.

3. A grease according to claim 2 wherein $R_2$ is para-phenyl, meta-phenyl, $C_1$, ortho-phenyl or a saturated $C_2$, $C_3$, $C_4$ or $C_5$ group and wherein $R_1$ contains from 12 to 25 carbon atoms.

4. A grease according to claim 3 wherein $R_1$ is selected from the group consisting essentially of $C_{16}$, $C_{18}$, $C_{20}$ and $C_{22}$ alkyl groups and wherein M is selected from the group consisting essentially of Li, Ca, Na and Ba.

5. A grease comprising an oil having lubricating quality, an effective amount of a thickening agent selected from the group consisting essentially of a metal salt of a pyrrolidone, an imide and mixture thereof and a complexing agent which comprises at least one metal phthalate salt, wherein said pyrrolidone and imide comprise a metal salt of a carboxylic acid connected by a respective substituted pyrrolidone or imide linkage to an alkyl or alkenyl hydrocarbon chain which may contain one or more of N, O, S or P.

6. A grease according to claim 5 wherein said pyrrolidone contains only one pyrrolidone group and is of the formula

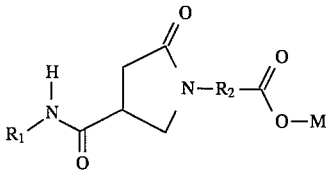

wherein said imide is of the formula

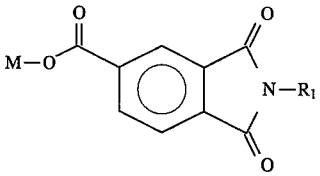

or

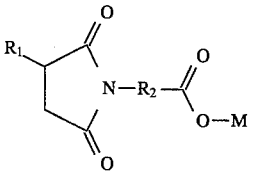

or a mixture of said imides, wherein $R_1$ is a straight or branched chain alkyl or alkenyl group having from 6 to 30 carbon atoms which may contain one or more of N, O, S or P, wherein $R_2$ is a hydrocarbyl group which may contain one or more of N, O, S or P, wherein M is a Group I or II metal, wherein $R_1$ and $R_2$ are the same or different for each thickener compound when more than one of said thickener compounds is present in said composition, wherein said phthalate is selected from the group consisting essentially of terephthalate, phthalate, isophthalate and mixture thereof and wherein the metal of said phthalate complexing agent is a Group I or II metal.

7. A grease according to claim 6 wherein $R_2$ is aryl, alkenyl or alkyl and wherein said complexing agent is a dimetal phthalate salt.

8. A grease according to claim 7 wherein $R_2$ is para-phenyl, meta-phenyl, $C_1$, ortho-phenyl or a saturated $C_2$, $C_3$, $C_4$ or $C_5$ group, wherein $R_1$ contains from 12 to 25 carbon atoms and wherein the metal present in said thickening agent and in said complexing agent is the same.

9. A grease according to claim 8 wherein $R_1$ is selected from the group consisting essentially of $C_{16}$, $C_{18}$, $C_{20}$ and $C_{22}$ alkyl group, wherein M is selected from the group consisting essentially of Li, Ca, Na and Ba and wherein said complexing agent comprises a dimetal terephthalate.

10. A grease according to claim 9 wherein the total amount of said thickener and said complexing agent present in said grease ranges between 2–30 wt. % of said grease, wherein the mole ratio of said complexing agent to said thickener ranges from 0.5 to 10 and wherein said oil comprises a hydrocarbon oil.

11. A grease according to claim 5 wherein said complexing agent comprises a dimetal terephthalate.

* * * * *